United States Patent [19]

Cardenas

[11] Patent Number: 4,875,737

[45] Date of Patent: Oct. 24, 1989

[54] DISASSEMBLABLE CORRUGATED BOARD BACKED CHAIR

[75] Inventor: Alfonso Cardenas, Pico Rivera, Calif.

[73] Assignee: Sunclipse, Inc., Montebello, Calif.

[21] Appl. No.: 253,494

[22] Filed: Oct. 5, 1988

[51] Int. Cl.[4] ..... A47C 7/00

[52] U.S. Cl. ..... 297/442; 297/440; 248/174

[58] Field of Search ..... 297/440, 442, 443; 428/542.8; 248/174, 165; 211/135, 195

[56] References Cited

U.S. PATENT DOCUMENTS

| | | | |
|---|---|---|---|
| 2,313,362 | 3/1943 | Rons | 297/442 |
| 2,940,513 | 6/1960 | Holden | 297/457 |
| 3,149,880 | 9/1964 | Stener | 297/442 |
| 3,312,503 | 4/1967 | Suzuki | 297/457 |
| 3,331,634 | 7/1967 | Harrison, Jr. | 297/442 |
| 3,717,377 | 2/1973 | Johnson | 297/442 |
| 4,085,970 | 4/1978 | Klein | 297/440 |
| 4,340,251 | 7/1982 | Geoffroy-Dechaume | 297/442 |
| 4,648,658 | 3/1987 | Calco | 297/440 |

*Primary Examiner*—Kenneth J. Dorner
*Assistant Examiner*—Brian K. Green
*Attorney, Agent, or Firm*—William H. Pavitt, Jr.; Vernon D. Beehler; Ralf H. Siegemund

[57] ABSTRACT

A disassemblable chair constructed of three corrugated paper board elements brought together and interlocked by slotting in each of the elements. The first and basic element may be die cut from a rectangular corrugated board sheet which is creased, bent over and secured along overlapping edges to form a rectangular cross sectional seat and back support. A second rectangular slotted element is disposed transversely across the seat supporting edges of the first element to complete the seat support; and a third rectangular element is laid over the seat and back support and secured by insertion of its end and a center fold into interlocking slotting in the first element.

13 Claims, 4 Drawing Sheets

110
36
10
110
100
52

DISASSEMBLABLE CORRUGATED BOARD BACKED CHAIR

FIELD OF THE INVENTION

This invention relates generally to the field of assemblable and disassemblable furniture, with particular application to the toy and game field. Chairs of the construction of the present invention may be utilized by persons desiring seating comfort at many different types of sporting or other events, where the user is not desirous of carrying to such event any such heretofore known type of portable chair.

BACKGROUND OF THE INVENTION

Chairs of innumerable types have been made from time beyond human memory. Included among the vast variety of chairs are those which may be collapsed in order to be more easily moved to a desired sitting location. Among such collapsible chairs are those made of pivotable wood or metal frames across which may extend some type of fabric for the seat and back. These chairs, however, are somewhat expensive and are heavy enough to constitute a burden where they have to be carried over long distances. In addition, when the fabric tears or rips out of its stitching, the chair becomes worthless unless the chair owner is prepared himself to replace the fabric or have it done by someone else.

On many occasions, people have used sturdy wooden or even cardboard boxes for seating, but these do not ordinarily come with any type of a back support. Moreover, if the box is carried flat and then opened up, it is not always found to be sturdy enough to sit upon.

In a recent article which appeared in the Los Angeles Times, a picture is shown of a fold-up portable chair, apparently made of corrugated board, which is reported to have been sold and used in viewing the 1987 Tournament of Roses Parade in Pasadena, California. This seat, however, appears to resemble an elongated box having an angular cut-out which serves as the seat and a short back support. It does not appear to offer much comfort, but it is featured as having been made of a corrugated board.

In addition, undoubtedly over the years, people have used various types of boxes, including those made of corrugated board for seats, but because the tops of the boxes are not made to support weight in the usual case, sitting on a corrugated board box will result in a buckling in the central area and even complete collapse of the box. SUMMARY OF THE INVENTION The present invention involves the use of a corrugated box structure in which a special reinforced seat is provided and the box itself is cut to provide a higher rearback supporting section and a lower seat section which is covered by a removable integral back and seat. The basic box-like seat and back support is transversely slotted at a plurality of preselected locations to receive edges or folds presented by two other elements forming the chair, namely, a seat support and an integral seat and back cover. In order to improve and secure in interlocking fashion the edges or folds inserted in such slots, each edge or fold itself is partially slotted at the point where it enters the slot provided for it in the box-like seat and back support. Such interlock also prevents its element from inadvertently being slipped laterally out of the slot in which it is seated.

All three elements may readily be dye cut from sheets of corrugated board and then folded at selected locations. In the case of the basic seat and back support, a rectangular sheet is cut inwardly a few inches from one edge downwardly, preferrably at an angle, to a lower level for a predetermined distance which will serve to define the upper edges of the forward box panel and the seat support portion of the side panels of the box. A similar angular cut is then made upwardly to the top edge of the sheet which then extends for the same distance as the front panel, to constitute the back panel of the box, and for a further short distance to provide an overlap on the initial uncut upper area of the sheet. The thus cut sheet is then creased along a series of predetermined vertical lines to enable the sheet to be formed to a series of right angle bends, the first to constitute the left corner of the seat support (looking toward the front of the chair), the second to constitute the right front corner, the third to constitute the right rear corner and the fourth to constitute the left rear corner, with the overlap then adhered along the initial edge of the left rear side of the box. After the overlap is secured, preferrably by an adhesive, the seat support may be either opened to its box-like configuration or flattened for convenient carrying or packaging.

At the time the sheet is cut by the dye, it should simultaneously be slotted at a plurality of preselected locations so that when the two edges of the sheet have been secured and the seat and back support is opened up to its intended supporting configuration, the other two elements required to form the chair may be appropriately slipped into such slotting, thereby to form the chair.

The first of the two remaining elements is a simple rectangular sheet of corrugated board which is, in essence, bent to form what is tantamount to a channel member having downwardly facing edges of which are inserted in the transverse slots extending downwardly from each of the two side panels. Desirably the space between these two pairs of slots should be recessed by the thickness of the corrugated board thus constituting the basic seat support.

The actual seat and back for the chair are comprised of a rectangle having a width in excess of the distance between the side panels of the seat support and a length, such that, when creased to form the required corners and folds, it will extend from inside the slotting in the forward panel to in front of that panel where it is first 90 degree cornered to extend upwardly to slightly above the top edge of that panel; where it is then again cornered and extended to cover the lower level edges of the box-like seat and back support; and then again cornered and folded back upon itself to extend up over the angled back support edges; where it is further cornered twice to present an edge insertable into the slotting at the rear of the top of the back support.

A chair constructed in accordance with the present invention, if its three elements are fabricated of a corrugated board of sufficient strength, will be found to be capable of supporting the weight of an average adult. It may readily be made in a small size for a small tot; or in a larger size to sustain an average adult. The three elements may be packaged in a compact flattened condition which may occupy a space no more than an inch in thickness and, as such, because of their light weight, may be carried in one hand, particularly if inserted in a flat container or carrying case. When the chair is to be set up for use, the of assembly of the three elements is extremely simple and quite obvious once the box-like seat and base support is opened up.

The chair may be taken to sporting, parade or other events where seating may not be provided, but may be desirable. The chair may also be used for children and may be made a part of a chair and table set for a child's playroom or school. In this connection, the panels of the chair may be printed with art or advertising work.

Since the cost of fabricating the three elements from which the chair is set up is so minimal, the chair elements may be sold at a very inexpensive price, with the result that after the chair has been used at a particular event, the user may choose simply to dispose of the chair, or simply leave it where it was used.

It will thus be found that the chair of the present invention offers many advantages over previously known portable chairs or other types of on-the-spot constructable seatings.

DESCRIPTION OF THE DRAWINGS

In the accompanying drawings.

DESCRIPTION OF THE PREFERRED EMBODIMENT

Figure 1:
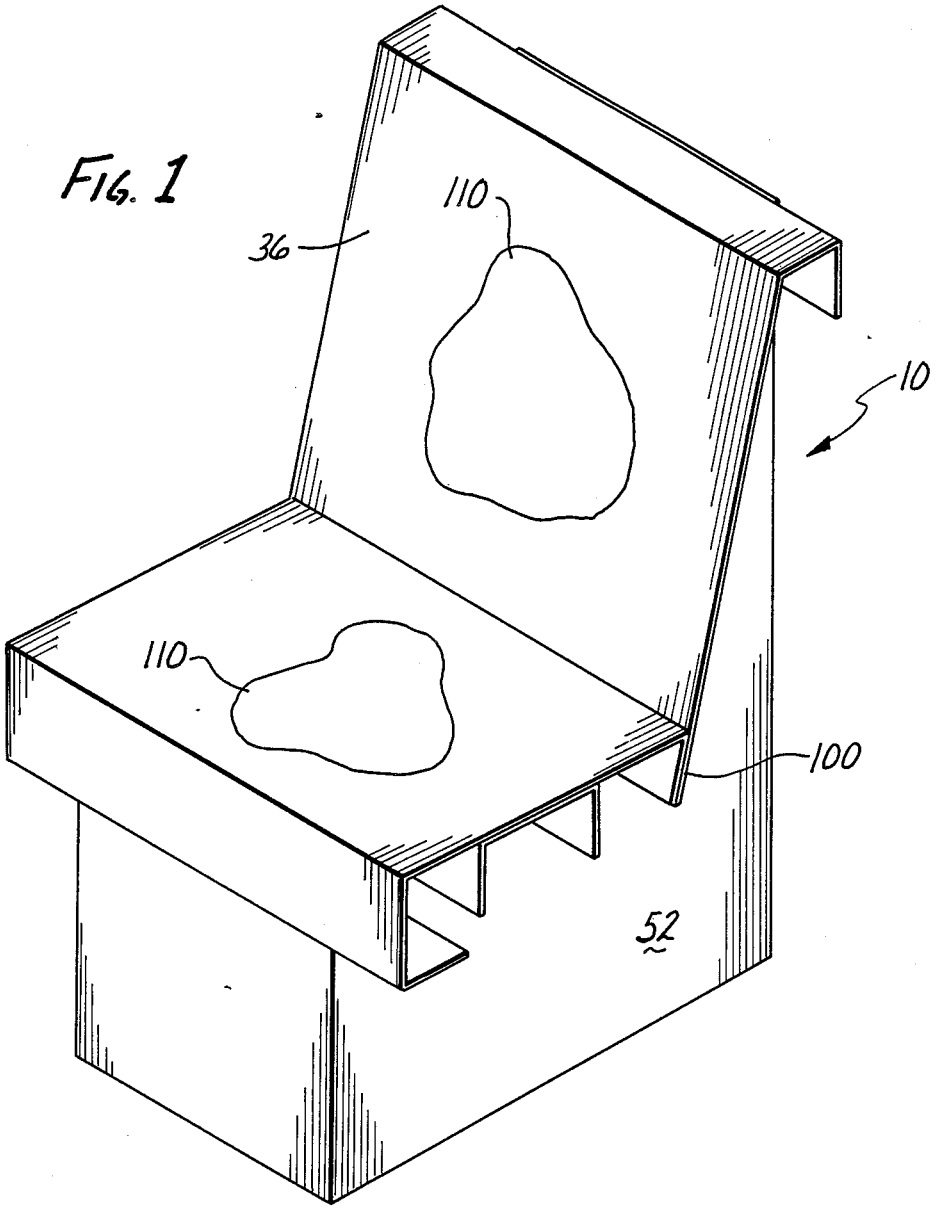
FIG. 1 is a perspective view of the preferred embodiment of the chair fully assembled.

FIG. 1 shows the chair 10 as completely assembled. However, for an understanding of its construction, it is desirable first to examine FIG. 4 which shows the basic box-like seat and back support 12 as it has been cut from a large rectangular sheet and prior to its being formed into the box-like seat and back support shown in FIG. 4*a*. At the time the sheet 12 is thus cut into the shape shown in FIG. 4, desirably the slottings 16, 18, 20, 22, 24, 26, 28, 30 and 32, and the recesses 34 and 36 are simultaneously cut by the dye, and the corrugated board sheet 12 is further impacted to provide vertical fold lines 40, 42, 44 and 46.

Figure 4:
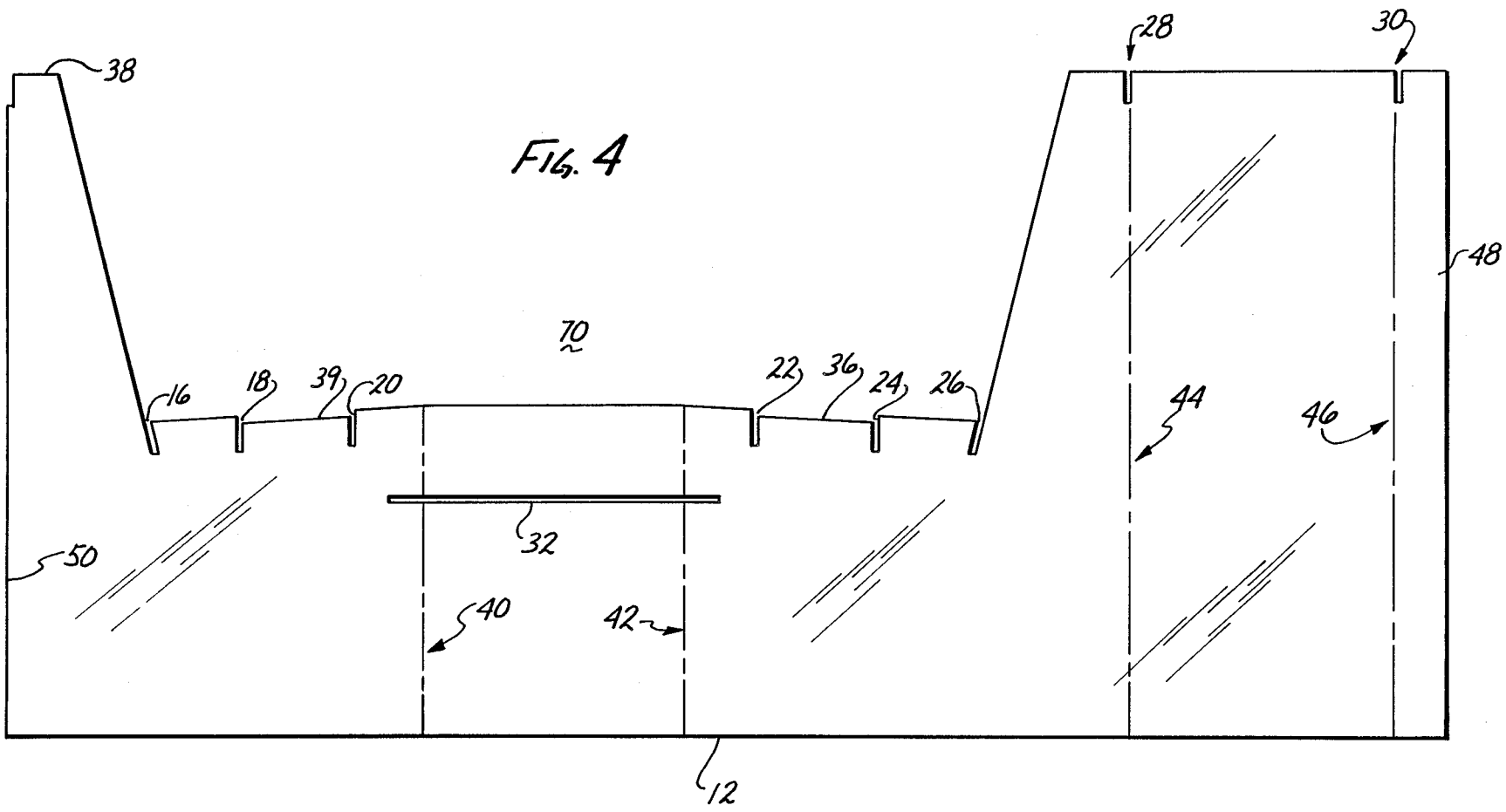
FIG. 4 is a plan view of the element after cutting and before bending and securing to form the box-like seat and back support member.
Figure 4A:
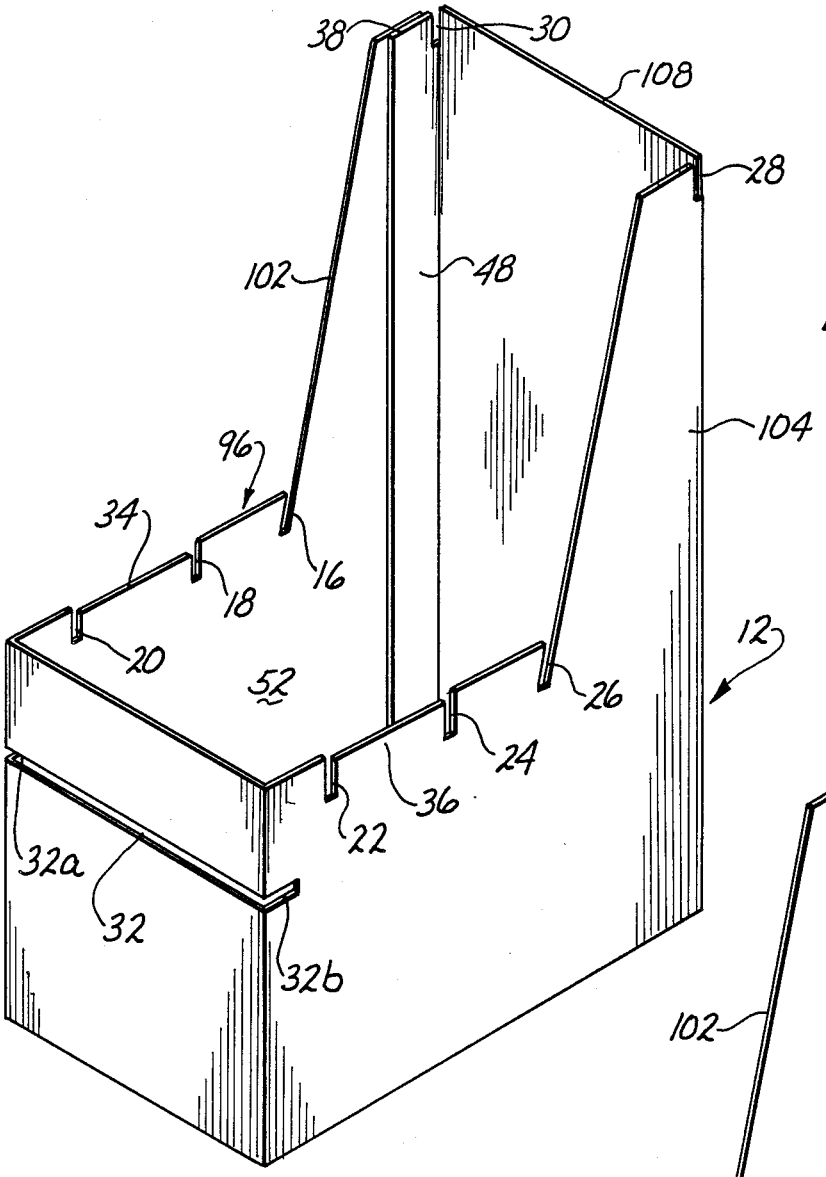
FIG. 4*a* is a perspective view of the box-like seat and back support member in its open position before the other two elements have been applied to produce the complete chair as shown in FIG. 1.

Upon removing the sheet 12 from the dye and bending the right hand portions of the sheet about each of the impacted and thus creased lines 40, 42, 44 and 46, back by a 90 degree angle, the sheet 12 will be found to assume the configuration shown in FIG. 4*a* and may be retained in that configuration by applying adhesive to the vertical panel 48 as its overlaps the left hand side edge 50 of what becomes the left side panel 52.

Figure 3:
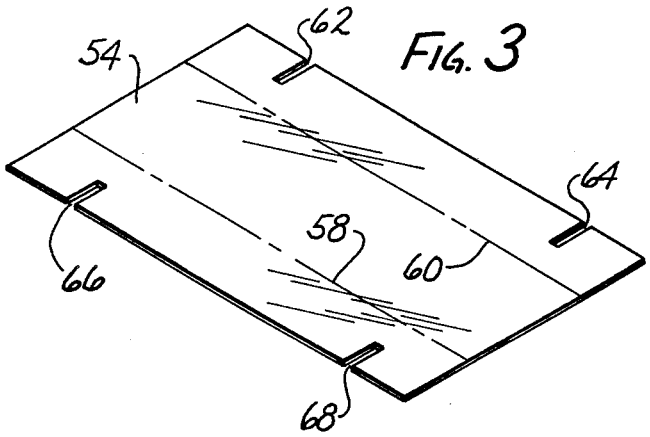
FIG. 3 is a perspective view of the seat support panel.

When so formed to assume the box-like configuration shown in FIG. 4*a*, the sheet 12 is not ready first to receive the seat support elements 54, and then the back and seat support 56. As may be seen from FIGS. 2 and 3, these last two mentioned elements are also preferrably dye cut and creased to provide in element 54, bending creases 58 and 60 and slots 62, 64, 66 and 68. In order to avoid material waste, the element 54 desirably may be cut simultaneously with the sheet 12 from the material which is eliminated to provide the central recess 70 as shown in FIG. 4.

The element 56 is also formed from a flat sheet to provide the slots 72, 74, 76, 78, 80 and 82 and is impacted to provide bending creases 84, 86, 88, 90, 92 and 94.

Figure 5:
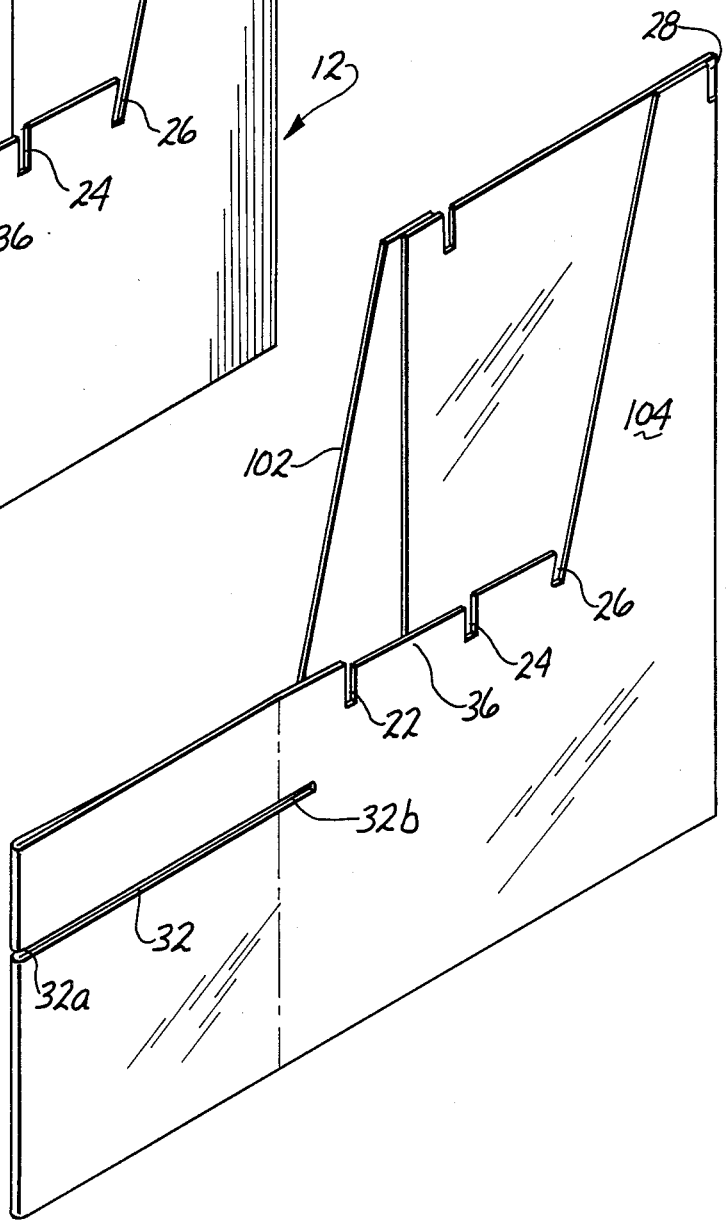
FIG. 5 is a perspective view of the member shown in FIG. 4*a* when flattened.

To assemble the chair, the element 54 is first bent to form the channel configuration shown in FIG. 1 and is then set in the recesses 34 and 36, with its slots 62, 64, 66 and 68 being interlocked with the slots 18, 24, 20 and 22, respectively on the upper edges 96 of the support box 12 shown in FIG. 4*a*. Thereby, not only is a firm seat support provided, but with the interlocking of the slots, flattening of the sheet 12 into the configuration shown in FIG. 5 is prevented.

Figure 2:
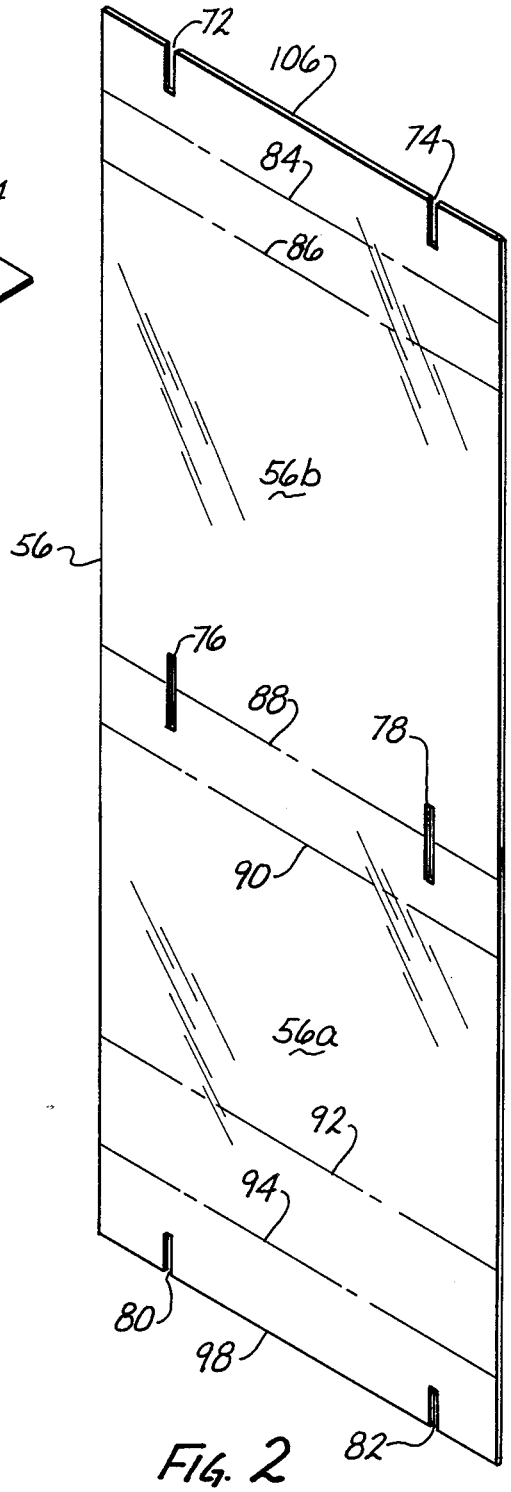
FIG. 2 is a perspective view of the seat and back support panel.

The element 56 shown in FIG. 2 is initially bent at 94 to form a 90 degree angle and the lower edge 98 is inserted in the slot 32 to interlock with the slots 80 and 82, respectively into the rearwardly extending portions 32*a* and 32*b* of the slot 32.

The element 56 is further bent along the creased line 92 to enable the portion 56*a* of the element 56 to be lain upon the upper edges 96 of the box-like seat and back support 12, across which the element 54 has been seated, as previously explained.

The element 56 is further bent downwardly at 90 and back upon itself at 88, and such bent back portion 100 is then inserted in the slots 16 and 26 to interlock therewith the slots 76 and 78, respectively. A portion 56*b* will thereupon extend upwardly as a back support panel resting on the angled edges 102, 104 of the sheet 12, and it is secured in position by further bending the element 56 along the crease line 86 and again along the line 84 so that the edge 106 may be brought into abutment with the rear upper edge 108 of the box-like support 12, and secured by interlocking the slots 72 and 74 with the slots 30 and 28, respectively.

Upon completion of the assembly of the three elements 12, 54 and 56 in the manner described, the result will be the chair shown in FIG. 1.

Each of the elements 12, 54 and 56 may be cut from a double face 200 test corrugated board which will be found to be of sufficient strength to support a seated person of at least 200 lbs. in weight. However, a heavier or differently fabricated paperboard may be utilized.

The chair may be made in different sizes. Thus, a child's chair may be made with a height of approximately 20 inches for the back and 9½ inches seat height. For an adult, the seat height may be substantially increased and the back height raised proportionately.

Particularly, in the case of childrens' chairs, the exposed panel faces may be printed with decorations, teaching aides, pictures or other subjects of interest 110.

Figure 6:
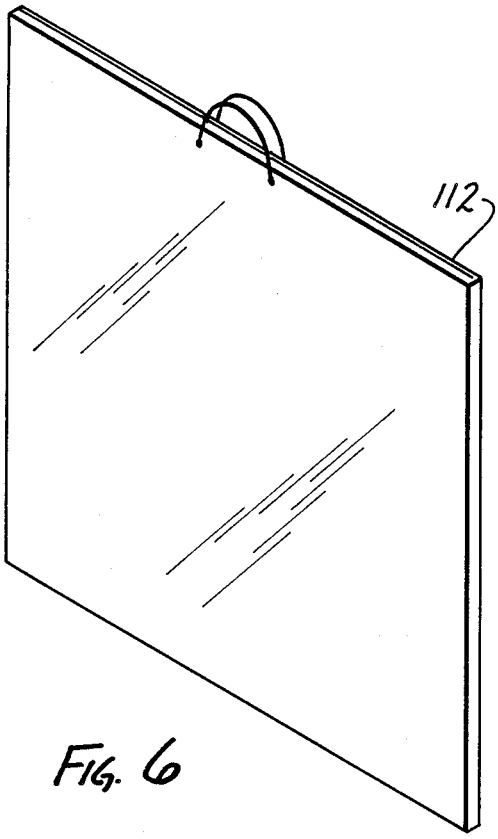
FIG. 6 is a perspective view of the carrying case for the three elements used to construct the chair.

Either before the three elements 12, 54 and 56 are assembled, or after the chair has been put together and has been disassembled, it may easily be carried in a simple flat portable carrier 112, such as is shown in FIG. 6. For this purpose, the element 12 is flattened in the manner shown in FIG. 5 and first inserted in the carrier, the element 54 is flattened to its form shown in FIG. 3, and the seat and back support 56 is flattened as shown in FIG. 2 and doubled upon itself about the fold line 90. Each of these elements 54 and 56 may then also be inserted into the carrier 112.

From the foregoing description, it will be appreciated that an assemblable chair may be constructed most inexpensively from sheets of corrugated board on a mass production basis, and carried at a minimum of inconvenience and burden to the site where it is desired to set up the chair for use. Its assembly and disassembly may easily be accomplished so that the chair, if desired, may be packed away for further usage at another location and at another time. However, because it is made of simple corrugated cardboard of the type from which many ordinary packing boxes are made, it may be disposed of after use at a minimum economic loss.

What is claimed is:

1. A backed chair assemblable from a group of corrugated board elements all of which, before asssembly, may be flattened for convenient packaging, said chair comprising:

A. Vertical means to interlockingly receive and position a seat support and a seat and back member, said means being formed from a first rectangular planar sheet of corrugated board, said first sheet being cut out to provide two side edge portions spaced from each other and an intermediate portion of lower height than said side edge portions, said sheet being bent along four vertical lines to form 90 degree corners, with one side edge folded back and secured to the other side edge to form a closable and openable set of four panels, comprising a lower front panel, two parallel spaced apart lower forward partial side panel portions, and a higher rear panel and higher partial rear side panel portions, the last said panel portions being angled down to the lower forward partial side portions, each of said four panels having upper and lower edges, each of the lower forward partial side panel portion being transversly slotted downwardly from its upper edges in two places spaced apart from each other and from the lower front panel, and further being slotted transversly downwardly from the points where the higher partial rear side panel portions join the lower forward partial side edge portions, and the lower front panel being transversely slotted into the adjoining two lower side panels below the upper edges of the front and lower forward partial side panels, the upper edges of the latter side panels between the two spaced apart transverse slottings being recessed to the extent of the thickness of the corrugated board;

B. A seat and back support, said support comprising a rectangular corrugated board at least slightly. greater in width than the distance between the side panels when the said vertical means is in the folded position, the said support being of a height equal to the total dimensions of the spacing between the two spaced apart transverse slottings and the depths of each pair of slottings on one side panel one end edge of, said seat and back support being inserted into one of the two pairs of spaced apart transverse slottings, said support being bent to a 90 degree angle to seat in said recessed upper edges of the side panels, and further bent to a 90 degree angle for insertion of its other end edge into the second spaced apart pair of transverse slottings; and C. A seat and back member formed of a rectangular corrugated board having a width at least slightly greater than the distance between the side panels when the vertical means is in its folded position, one end of said seat and back member being inserted in the slotting in the lower front panel, said member being bent at right angles upardly first to extend the seat and back member up over the front panel, and then on the upper side panel edges; said seat and back support member further being doubled back upon itself for insertion into the slotting where the lower forward partial side panel portions and higher partial rear side panel portions; join each other, and to extend further over the upper edges of the higher partial rear side panel portions for securing in an upper region thereof, thereby to form a supported seat and chair back.

2. The backed chair as described in claim 1 wherein the higher partial rear side panel portions join the lower side panel portions at a slightly obtuse angle, and the transverse slotting at such point of joinder extends into the lower side panel portion at the vertex of said obtuse angle side.

3. The backed chair as described in claim 1 wherein additional transverse slotting is provided across the upper edges of the higher partial side panel portions to receive and secure in position an end of the seat and back member which extends up over the edges of the higher partial side panel portions, said end being bent back over said upper edges for insertion into such additional slotting.

4. The backed chair as provided in claim 1 where inte ends of the seat end back support member which are inserted into slotting are themselves slotted partially to increase the depth of interlock in each slotting.

5. The backing chair as described in claim 1 wherein each portion of the seat and back member which is inserted into slotting is itself slotted at the point of entry thereby to increase the extent of interlock through its slotting.

6. The backed chair as described in claim 1 wherein at least one exposed panel of the vertical means or the seat and back member is provided with a decoration.

7. The backed chair as described in claim 1 wherein the corrugated board for the vertical means and the seat and back support is double faced 200 test C-flute corrugated board.

8. The backed chair as described in claim 1 wherein the seat and back support, the seat support member and the seat and back member are all formed of double faced 200 test C-flute corrugated board.

9. A corrugated board chair comprising:

A. A corrugated board sheet formed into a box-like configuration with a front panel, said front panel having an upper edge and being transversely slotted below said edge two side panels and a rear panel, each panel having upper and lower edges and opened at its top and bottom to define a cavity rectangular in horizontal cross-section, the rear panel and edge portions or each side panel connected to the rear panel being higher than the upper edges of the remainder of the portions of the side panels, said higher side panel edges being joined to said lower upper side edge panel portions by angular intermediate edge portions, each of said lower side edges being slotted transversely at two locations spaced from each other and from the front panel, and further being transversely slotted at the point where said lower edge meets the said angular intermediate edge;

said front panel being transversely slotted below its upper edge, and slotting being extended into the side panels;

B. A corrugated board channel member, said channel member being inverted to present downwardly extending edges and disposed transversely to, and seated on, said side panels with the edges of said channel member extending into the spaced apart slots in the upper edges of said side panels; and C. A corrugated board seat and back panel, said panel being of a width greater than the distance between said two side panel edges when the corrugated board sheet is in its box-like configuration and having one end inserted into said front panel slotting and its extensions into the side panels, being bent 90 degrees to extend up over the upper edge of the front panel and further simularly bent to lay on the upper edges of the lower side panels edge portions, and on said channel member; being further bent back upon itself for insertion into the slotting where the angular intermediate edges join the said lower side panel edge portions, and further laid over the angular intermediate edges to extend up over the higher side panel edges for securing thereon.

10. The corrugated board chair as described in claim 9 wherein the upper edges of the side panel members between the spaced apart slotting are recessed to the approximate thickness of the corrugated board channel member.

11. The corrugated board chair as described in claim 9 wherein the edges of the corrugated board channel member are slotted at the points where said edges extend into the spaced apart slots in said side panels to interlock said channel members in the side panel slottings.

12. The corrugated board chair as described in claim 9 wherein each portion of the seat and back panel which is inserted into slotting in any of said front and said side panels is itself slotted for better interlocking with its respective panel.

13. The corrugated board chair as described in claim 9 wherein the corrugated board for the corrugated board sheet formed in a box-like configuration, the corrugated board channel member and the corrugated seat and back panel is double faced of at least 200 test C-flute corrugated board.

* * * * *